US008602824B2

(12) United States Patent
Li et al.

(10) Patent No.: US 8,602,824 B2
(45) Date of Patent: Dec. 10, 2013

(54) ULTRATHIN USB FEMALE CONNECTOR

(75) Inventors: Zhixiong Li, Guangdong (CN); Min Qin, Guangdong (CN); Ping Wang, Guangdong (CN)

(73) Assignee: Shenzhen Netcom Electronics Co., Ltd., Guangdong (CN)

( * ) Notice: Subject to any disclaimer, the term of this patent is extended or adjusted under 35 U.S.C. 154(b) by 142 days.

(21) Appl. No.: 13/318,529

(22) PCT Filed: Jul. 28, 2010

(86) PCT No.: PCT/CN2010/075506

§ 371 (c)(1), (2), (4) Date: Nov. 2, 2011

(87) PCT Pub. No.: WO2011/130967

PCT Pub. Date: Oct. 27, 2011

(65) Prior Publication Data

US 2012/0052743 A1 Mar. 1, 2012

(30) Foreign Application Priority Data

Apr. 21, 2010 (CN) ..... 2010 1 0156123

(51) Int. Cl.
*H01R 9/03* (2006.01)

(52) U.S. Cl.
USPC ..... 439/607.55

(58) Field of Classification Search
USPC ..... 439/131–135, 607.55–607.56
See application file for complete search history.

(56) References Cited

U.S. PATENT DOCUMENTS

| | | | | |
|---|---|---|---|---|
| 7,803,005 | B1 * | 9/2010 | Speaker, IV | 439/278 |
| 2006/0079996 | A1 * | 4/2006 | Benouali | 700/244 |
| 2009/0325417 | A1 * | 12/2009 | Ko | 439/350 |

* cited by examiner

*Primary Examiner* — Renee Luebke
*Assistant Examiner* — Larisa Tsukerman
(74) *Attorney, Agent, or Firm* — Rosenberg, Klein & Lee

(57) ABSTRACT

An adjustable USB female connector includes a metal top shell, an insulated main body with connection pins which are compatible with USB interface protocol, and a metal bottom shell. The connection pins are fixed on the insulated main body. The insulated main body is fastened in the metal top shell. The metal top shell is slidably connected to the metal bottom shell, and the total thickness of the metal top shell and the metal bottom shell is variant. In a first orientation, the thickness of the USB female connector is the smallest, and the thickness is smaller than that of the standard USB female connector. In a second orientation, the metal bottom shell is pulled out, the thickness of the USB female connector increases and reaches the thickness of the standard USB female connector.

8 Claims, 5 Drawing Sheets

ULTRATHIN USB FEMALE CONNECTOR

FIELD OF THE INVENTION

The present invention relates to connectors, and more particularly, to an ultrathin USB female connector.

BACKGROUND OF THE INVENTION

As the rapid development of the electronic technology, electronic devices (for examples, computers, printers, projectors and so on) are generally electrically connected with each other via USB connectors. A USB connector includes a USB male connector and a USB female connector, the USB male connector is electrically connected to one electronic device, the USB female connector is electrically connected to another electronic device. The USB male connector is plugged into the USB female connector to realize electrical connection of the two electronic devices.

The conventional USB female connector includes a metal shell, an insulated main body, and multiple connection pins. The connection pins are fixed on the insulated main body, and the insulated main body is fastened in the metal shell. The USB male connector has the same structure with the USB female connector. When the USB male connector is plugged into the USB female connector, the metal shells of the two are engaged and the connection pins of the two get in touch with each other, thus the USB male connector and the USB female connector are electrically connected to each other.

Although the conventional USB male connectors and USB female connectors are very universal in electronic devices, there are some problems listed below: because the conventional USB female connectors are thick, more precisely, the metal shells of the USB female connectors are very thick, the conventional ultrathin devices (like Mobile Internet Device, walkman) can only be assembled with mini USB female connectors because of size problem. When a mini USB female connector is connected to a standard USB male connector, an additional USB transfer line used to transfer the mini USB connector to a USB connector is needed, the USB transfer line connects the mini USB female connector with a standard USB female connector, and then the standard USB female connector connects with the standard USB male connector. Since an additional USB transfer line is needed, it is very inconvenient for the users to use.

SUMMARY OF THE INVENTION

It is an object of the present invention to provide an ultrathin USB female connector that can be applied to ultrathin devices.

An ultrathin USB female connector includes a metal top shell, an insulated main body with connection pins being compatible with USB interface protocol, and a metal bottom shell; wherein the connection pins are fixed on the insulated main body, the insulated main body is fastened in the metal top shell, the metal top shell is slidably connected to the metal bottom shell, and the total thickness of the metal top shell and the metal bottom shell is variant.

In a preferred embodiment, each of the two side walls of the metal top shell has a slant guide slot, and each of the two side walls of the metal bottom shell is installed a first slide bar and a second slide bar; the first slide bars are fixed in a pair of mounting holes of the two side walls of the metal bottom shell, the second slide bars are slidably inserted in a pair of slantly set slide-guide slots of the two side walls of the metal bottom shell, the first slide bars and the second slide bars are slidably inserted in the slant guide slot.

In a preferred embodiment, each of the two side walls of the metal top shell has two different height limit slots, and each of the two side walls of the metal bottom shell has a resilient member may be inserted in one of the two limit slots.

In a preferred embodiment, a seal cover is connected to the outer surface of the bottom of the metal bottom shell.

In a preferred embodiment, the seal cover is made of polyvinyl chloride.

In a preferred embodiment, the connection pins are compatible with the USB2.0 interface protocol.

In a preferred embodiment, the connection pins are compatible with the USB3.0 interface protocol.

DETAILED DESCRIPTION OF THE EMBODIMENTS

Figure 1:
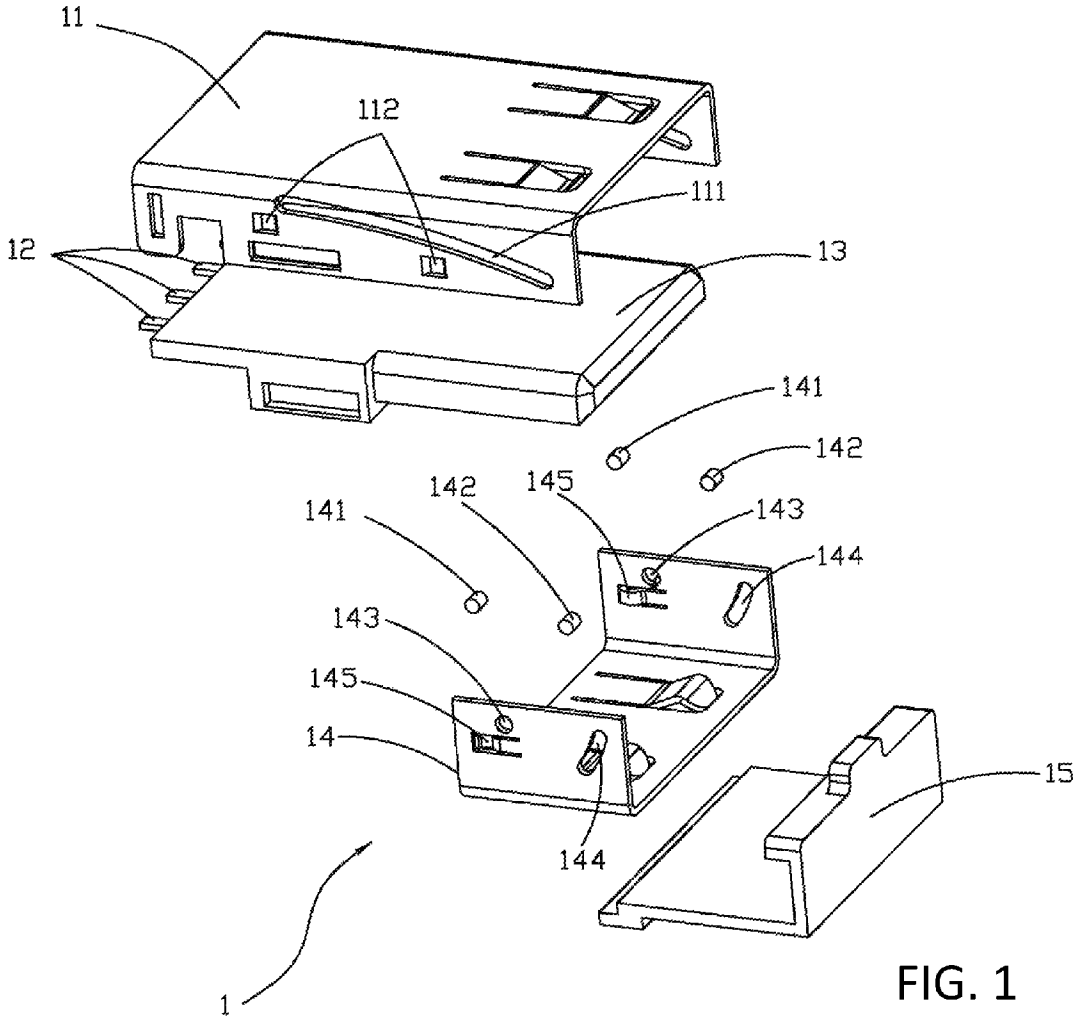
FIG. 1 is an exploded view of an ultrathin USB female connector in accordance with an embodiment of the present invention.
Figure 2:
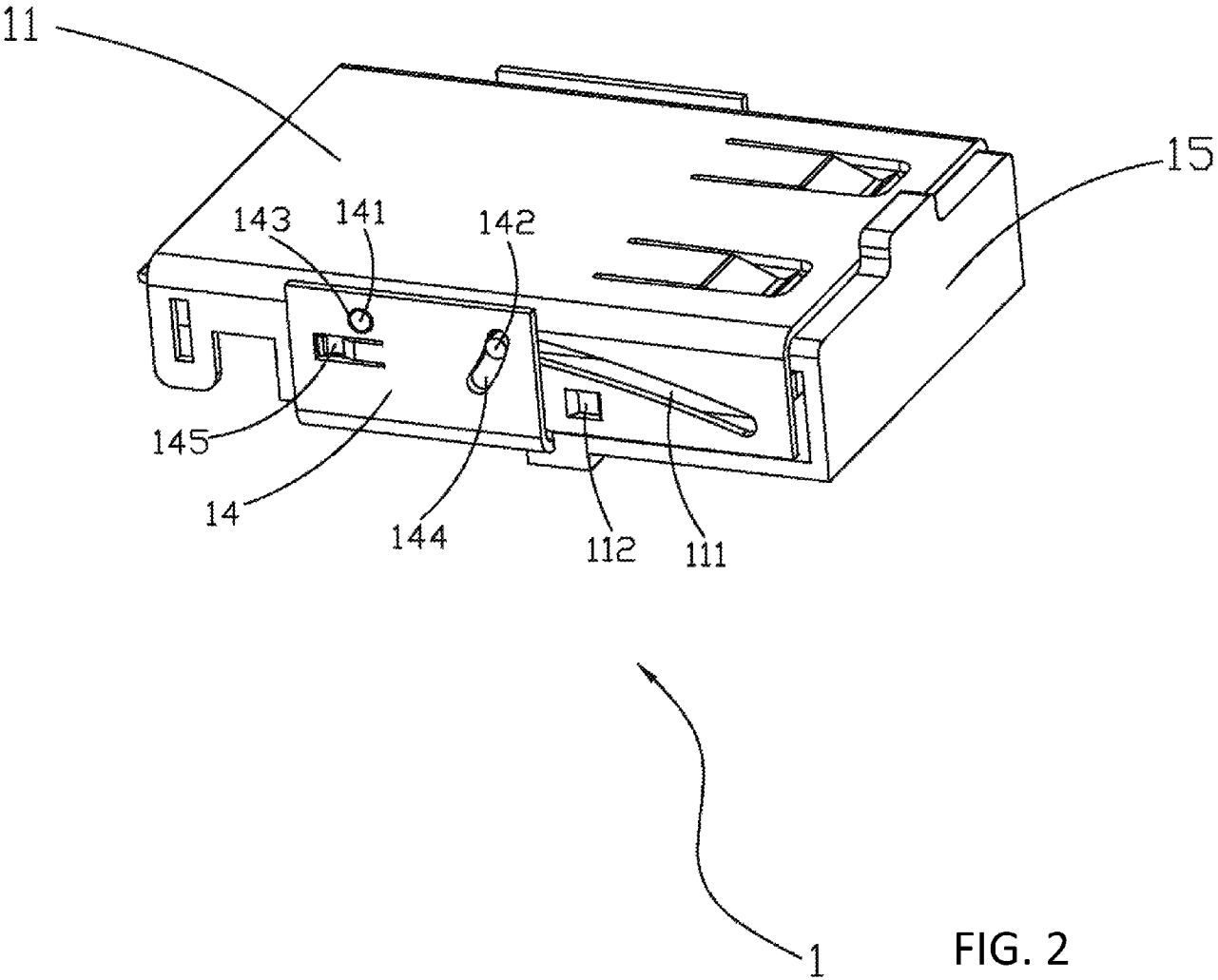
FIG. 2 is an assembly diagram of an ultrathin USB female connector in closed state in accordance with an embodiment of the present invention.
Figure 3:
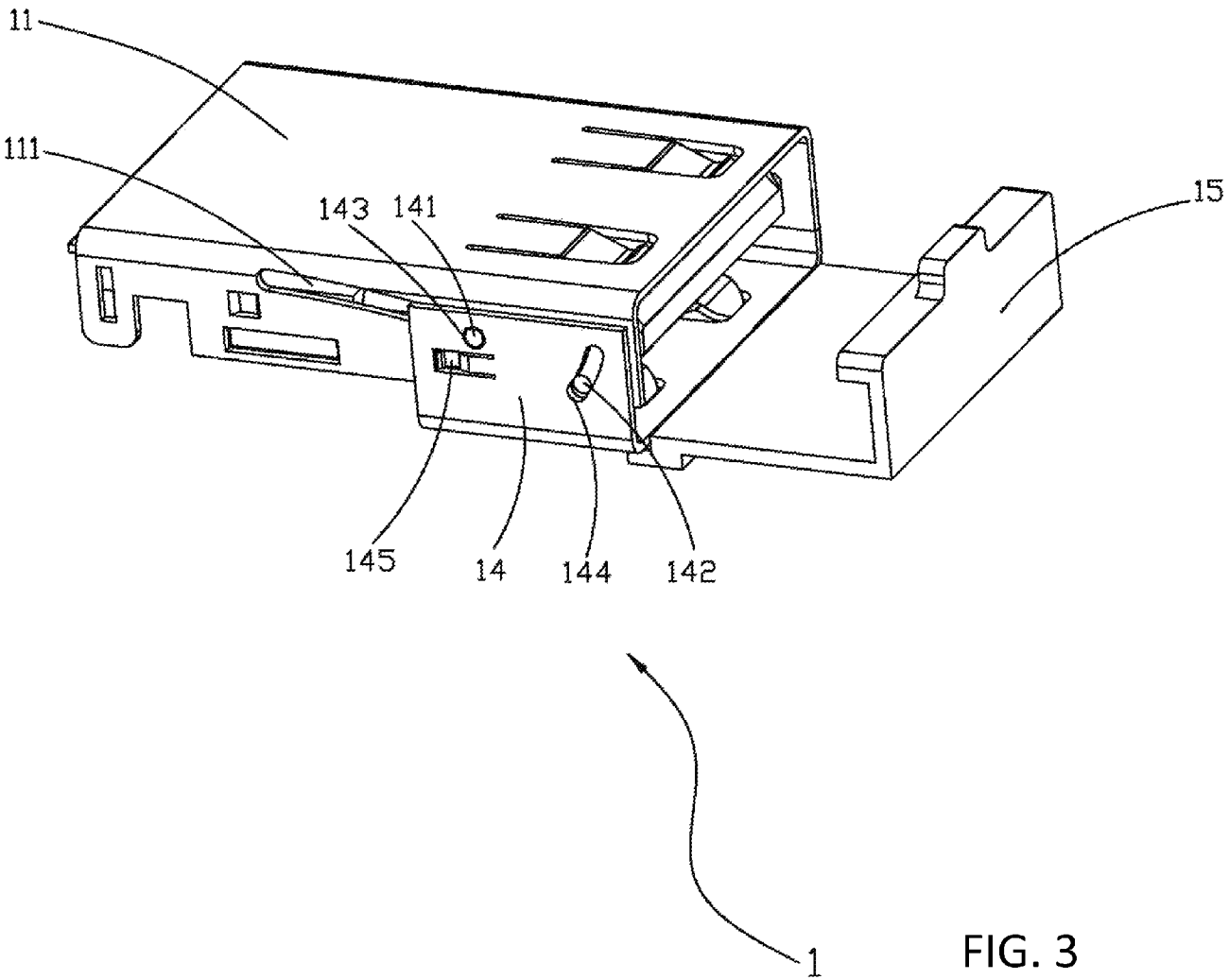
FIG. 3 is an assembly diagram of an ultrathin USB female connector in open and using state in accordance with an embodiment of the present invention.
Figure 4:
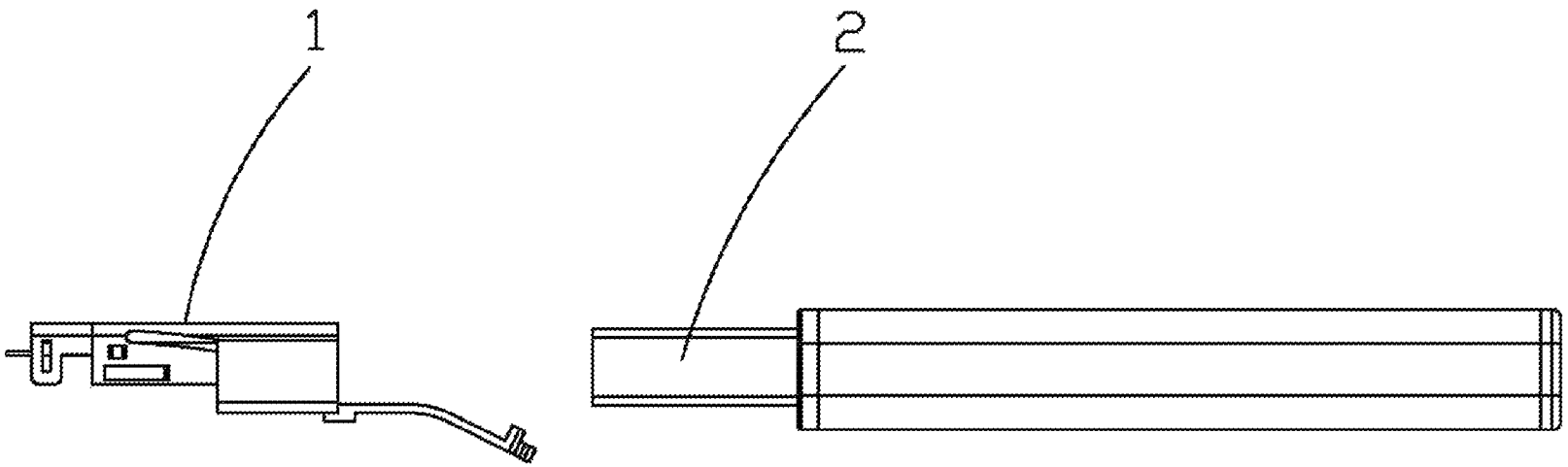
FIG. 4 is a schematic diagram of an ultrathin USB female connector of an embodiment of the present invention being plugged into a standard USB male connector.
Figure 5:
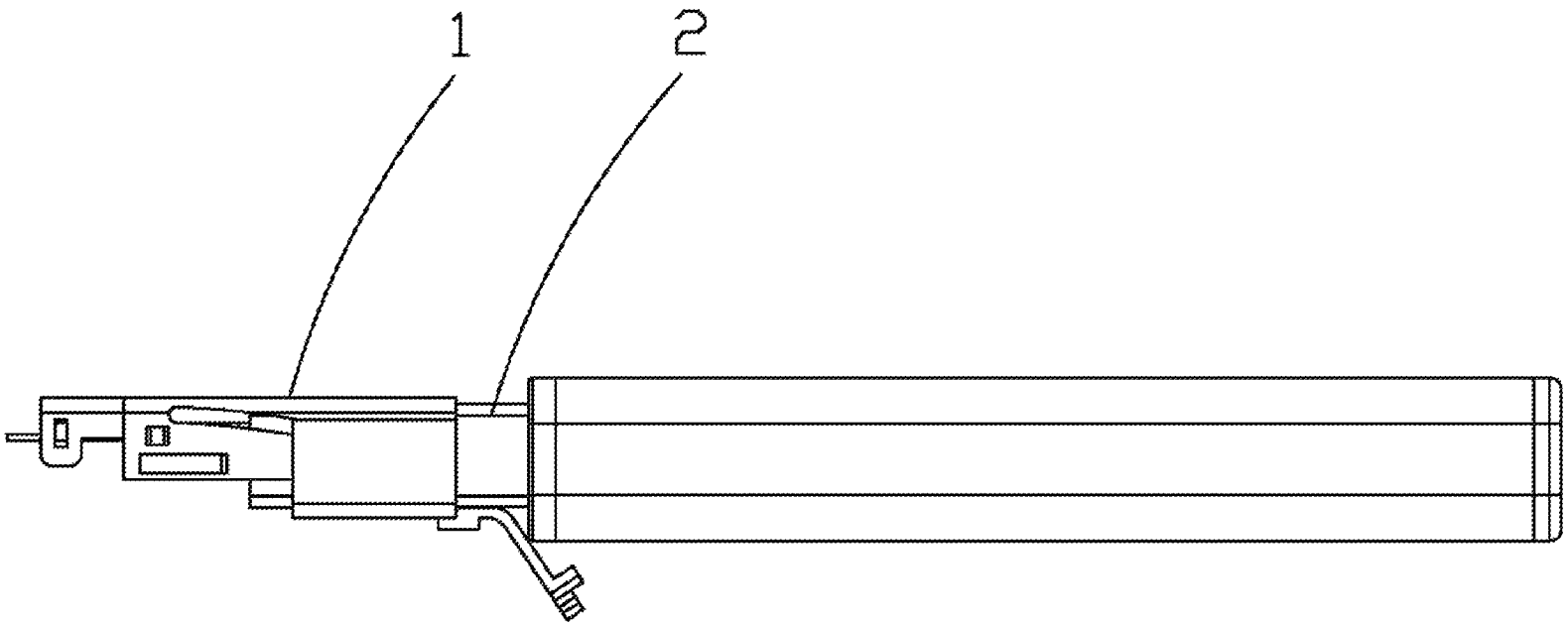
FIG. 5 is a schematic diagram of an ultrathin USB female connector of an embodiment of the present invention having been plugged into a standard USB male connector.

Referring to FIGS. 1 to 5, an ultrathin USB female connector 1 of an embodiment of the present disclosure includes a metal top shell 11, an insulated main body 13 with connection pins 12 which are compatible with USB interface protocol, and a metal bottom shell 14. The connection pins 12 are fixed on the insulated main body 13. The insulated main body 13 is fastened in the metal top shell 11. The metal top shell 11 is slidably connected to the metal bottom shell 14, and the total thickness of the metal top shell 11 and the metal bottom shell 14 is variant. When the metal top shell 11 and the metal bottom shell 14 are completely matched, the thickness of the USB female connector is the smallest, and is smaller than the thickness of the conventional standard USB female connector, so that the ultrathin USB female connector of the present invention could be applied to ultrathin devices. When the ultrathin USB female connector is plugged into a standard USB male connector 2, the metal bottom shell 14 is pulled out, the thickness of the USB female connector 1 increases, and finally reaches to the thickness of the standard USB female connector, then it can be plugged into the standard USB male connector 2, thus the connection of the ultrathin USB female connector of the present invention with the electronic devices is realized.

More detailed introduction of the components of the present invention is described below.

As FIG. 1 to FIG. 5 show, the slidable connection between the metal top shell 11 and the metal bottom shell 14 is: each of the two side walls of the metal top shell 11 has a slant guide slot 111, and a first slide bar 141 and a second slide bar 142 are installed on each of the two side walls of the metal bottom shell 14. The first slide bars 141 are fixed in a pair of mounting holes 143 of the two side walls of the metal bottom shell 14. The second slide bars 142 are slidably inserted in a pair of slantly set slide-guide slots 144 of the two side walls of the metal bottom shell 14. The first slide bars 141 and the second slide bars 142 are slidably inserted in the slant guide slot 111. As the first slide bars 141 and the second slide bars 142 slide up and down along the slant guide slot 111, the second slide bars 142 are also slid up and down along the slide-guide slot 144 at the same time. The reason of making the second slide bars 142 slide in the slide-guide slot 144 is to guarantee the second slide bars 142 slide in the slant guide slot 111 more smoothly. The first slide bars 141 and the second slide bars 142 are specifically metal pins which have higher strength.

After the metal top shell 11 is matched with the metal bottom shell 14, the first slide bars 141 and the second slide bars 142 are slidably inserted in the slant guide slot 111, such that the metal top shell 11 is slidably connected to the metal bottom shell 14. When the first slide bars 141 and the second slide bars 142 slide upward along 111, the metal top shell 11 and the metal bottom shell 14 are gradually matched together. The thickness of the ultrathin USB female connector 1 becomes smaller, and the thickness of the ultrathin USB female connector 1 is less than the thickness of the standard USB female connector, so that the ultrathin USB female connector 1 can be applied to ultrathin devices. When the first slide bars 141 and the second slide bars 142 slide downward along the slant guide slot 111, the metal top shell 11 is gradually detached from the metal bottom shell 14, and the metal bottom shell 14 is moved outward, the thickness of the ultrathin USB female connector 1 increases gradually, and finally reaches to the thickness of the standard USB female connector, and then the ultrathin USB female connector 1 can be matched with the standard USB male connector 2, thus realizing the object of connecting the ultrathin USB female connector of the present invention with the electronic devices.

In the process of the first slide bars 141 and the second slide bars 142 sliding upward or downward along the slant guide slot 111, in order to make the first slide bars 141 stop at the highest or lowest point precisely, such that the thickness of the ultrathin USB female connector 1 is the smallest or the biggest, each of the two side walls of the metal top shell 11 of the present invention has two different height limit slots 112, and the two side walls of the metal bottom shell 14 form two resilient members 145 which can be inserted in the limit slots 112 respectively. When the first slide bars 141 and the second slide bars 142 slide upward along 111 to the highest point, the resilient members 145 at the two sides of the metal bottom shell 14 insert in the limit slots 112 of the biggest height, such that the total thickness of the metal top shell 11 and the metal bottom shell 14 is the smallest, and the position of the metal top shell 11 and the metal bottom shell 14 is kept unchanged, that is, the ultrathin USB female connector 1 is in closed state. When the first slide bars 141 and the second slide bars 142 slide downward along the slant guide slot 111 to arrive at the lowest point, the resilien member 145 at the two sides of the metal bottom shell 14 is inserted in the limit slots 112 of the smallest height, such that the total thickness of the metal top shell 11 and the metal bottom shell 14 is the biggest, and the position of the metal top shell 11 and the metal bottom shell 14 is kept unchanged, that is, the ultrathin USB female connector 1 is in open and using state, and is ready to be plugged into the standard USB male connector 2.

In a preferred embodiment, a seal cover 15 is connected to the outer surface of the bottom of the metal bottom shell 14. The seal cover 15 can cover the opening formed by the metal top shell 11 and the metal bottom shell 14 for the function of preventing dust, extending the service life of the ultrathin USB female connector 1. Meanwhile, if the metal bottom shell 14 needs to be pulled out, the metal bottom shell 14 can be pulled out by pulling the seal cover 15 outward, now the ultrathin USB female connector 1 is in open state and has a room for the standard USB male connector 2 to plug in, thus provide much convenience to users.

Specifically, the seal cover 15 is made of polyvinyl chloride, which has good flexibility and corrosion resistance, so the seal cover 15 is very durable.

Other structures of the ultrathin USB female connector 1 of the present invention are the same with the structure of the conventional USB female connector and will not be summarized here.

If the ultrathin USB female connector 1 of the present invention is USB2.0, connection pins compatible with the USB2.0 interface protocol should be set on the insulated main body 13. If the ultrathin USB female connector 1 of the present invention is USB3.0, connection pins compatible with the USB3.0 interface protocol should be set on the insulated main body 13. The ultrathin USB female connectors 1 with the two protocols are both protected by the present invention.

Although the present invention has been described with reference to the embodiments thereof and the best modes for carrying out the present invention, it is apparent to those skilled in the art that a variety of modifications and changes may be made without departing from the scope of the present invention, which is intended to be defined by the appended claims.

What is claimed is:

1. An ultrathin USB female connector, comprising:

a metal top shell;

an insulated main body with connection pins being compatible with USB interface protocol; and a metal bottom shell;

wherein the connection pins are fixed on the insulated main body, the insulated main body is fastened in the metal top shell, the metal top shell is slidably connected to the metal bottom shell, and the total thickness of the metal top shell and the metal bottom shell is variant; and wherein each of the two side walls of the metal top shell has a slant guide slot, and each of the two side walls of the metal bottom shell is installed a first slide bar and a second slide bar; the first slide bars are fixed in a pair of mounting holes of the two side walls of the metal bottom shell, the second slide bars are slidably inserted in a pair of slantly set slide-guide slots of the two side walls of the metal bottom shell, the first slide bars and the second slide bars are slidably inserted in the slant guide slot.

2. The ultrathin USB female connector of claim 1, wherein each of the two side walls of the metal top shell has two different height limit slots, and each of the two side walls of the metal bottom shell has a resilient member may be inserted in one of the two limit slots.

3. The ultrathin USB female connector of claim 2, wherein a seal cover is connected to the outer surface of the bottom of the metal bottom shell.

4. The ultrathin USB female connector of claim 1, wherein a seal cover is connected to the outer surface of the bottom of the metal bottom shell.

5. The ultrathin USB female connector of claim 4, wherein the seal cover is made of polyvinyl chloride.

6. The ultrathin USB female connector of claim 1, wherein the connection pins are compatible with the USB2.0 interface protocol.

7. The ultrathin USB female connector of claim 1, wherein the connection pins are compatible with the USB3.0 interface protocol.

8. The ultrathin USB female connector of claim 3, wherein the seal cover is made of polyvinyl chloride.

* * * * *